US006824357B2

(12) United States Patent
Stanzel

(10) Patent No.: US 6,824,357 B2
(45) Date of Patent: Nov. 30, 2004

(54) TURBOMOLECULAR PUMP

(75) Inventor: Jorg Stanzel, Wetzlar (DE)

(73) Assignee: Pfeiffer Vacuum GmbH, Asslar (DE)

( * ) Notice: Subject to any disclaimer, the term of this patent is extended or adjusted under 35 U.S.C. 154(b) by 19 days.

(21) Appl. No.: 10/229,679

(22) Filed: Aug. 27, 2002

(65) Prior Publication Data

US 2003/0044270 A1 Mar. 6, 2003

(30) Foreign Application Priority Data

Aug. 30, 2001 (DE) ..... 101 42 567

(51) Int. Cl.[7] ..... F01D 11/00; F01D 25/08; F01D 25/16; F01D 25/18; F04D 29/58

(52) U.S. Cl. ..... 415/175; 417/423.4; 417/423.5; 415/90

(58) Field of Search ..... 417/423.4, 423.5, 417/423.8; 415/90, 145, 209.3

(56) References Cited

U.S. PATENT DOCUMENTS

| | | | | | |
|---|---|---|---|---|---|
| 4,140,441 | A | | 2/1979 | Patterson | |
| 4,904,155 | A | * | 2/1990 | Nagaoka et al. | 415/90 |
| 4,929,151 | A | * | 5/1990 | Long et al. | 415/177 |
| 5,040,949 | A | * | 8/1991 | Crinquette et al. | 417/205 |
| 5,577,883 | A | * | 11/1996 | Schutz et al. | 415/90 |
| 5,924,841 | A | * | 7/1999 | Okamura et al. | 415/90 |
| 6,019,581 | A | | 2/2000 | Schulz-Hausmann et al. | |
| 6,106,223 | A | * | 8/2000 | Leyshon | 415/90 |
| 6,220,831 | B1 | * | 4/2001 | Shiokawa et al. | 417/423.4 |
| 6,461,123 | B1 | * | 10/2002 | Lotz | 417/423.4 |
| 6,524,060 | B2 | * | 2/2003 | Conrad et al. | 415/90 |
| 6,561,755 | B1 | | 5/2003 | Lotz et al. | |
| 6,599,108 | B2 | * | 7/2003 | Yamashita | 417/423.4 |
| 6,638,010 | B2 | * | 10/2003 | Conrad et al. | 415/90 |
| 6,699,009 | B2 | * | 3/2004 | Fahrenbach | 415/90 |

FOREIGN PATENT DOCUMENTS

| | | | | |
|---|---|---|---|---|
| DE | 2757599 | | 6/1979 | |
| DE | 9937392 | | 2/2001 | |
| EP | 0694699 | | 1/1996 | |
| EP | 08555175 | | 7/1998 | |
| JP | 362258186 | A * | 11/1987 | 415/90 |
| JP | 363109299 | A * | 5/1988 | 415/90 |
| JP | 363266190 | A * | 11/1988 | 415/90 |
| JP | 401167497 | A * | 7/1989 | 417/423.4 |
| JP | 401267392 | A * | 10/1989 | 415/90 |
| JP | 403124998 | A * | 5/1991 | 417/423.4 |
| JP | 404112997 | A * | 4/1992 | 417/423.4 |
| WO | 9407033 | | 3/1994 | |

* cited by examiner

*Primary Examiner*—Charles G. Freay
*Assistant Examiner*—William H. Rodriguez
(74) *Attorney, Agent, or Firm*—Sidley, Austin Brown & Wood, LLP

(57) ABSTRACT

A turbomolecular pump including a housing having a suction opening and a gas outlet opening, and a plurality of alternatingly arranged one behind another, stator and stator rings provided, respectively with support rings for supporting each a blade, with a support ring of a stator disc located adjacent to a high pressure region of the turbomolecular pump being connected with an adjacent housing part over a large surface or being formed with the adjacent housing part as one-piece part.

11 Claims, 3 Drawing Sheets

TURBOMOLECULAR PUMP

BACKGROUND OF THE INVENTION

1. Field of the Invention

The present invention relates to a turbomolecular pump including a housing having a suction opening and a gas outlet opening, and a plurality of alternatingly arranged one behind another, stator and stator discs provided, respectively, with support rings for supporting each blade.

2. Description of the Prior Art

Vacuum pumps, which are formed as turbomolecular pumps, as a rule, have a plurality of stages formed of alternatingly arranged one behind the other, stator and rotor discs. In order to obtain optimal pump characteristics, such as a maximal compression, the rotor discs should rotate with a very, high speed. The drive energy, which is required to provide for the high speed rotation of the rotor discs, is partially converted into the kinetic energy, a large portion of which is released in form of heat. Other undesirable heat quantities are produced in bearings (mechanical losses resulting from friction in the ball bearings or electrical losses in magnetic bearings) or as a result of the compression of gases. The generated heat can cause overheating of critical components of a turbomolecular pump. This should be prevented. Thus, an effective heat removal is necessary in the turbomolecular pumps.

The heat transfer in vacuum from rotor components to stator components is effected substantially by radiation.

Because rotor and stator discs face each other along large surfaces, a large portion of heat can be transmitted from rotor discs to stator discs by radiation. The stator discs are connected with the housing of a turbomolecular pump by spacer rings, as disclosed, e.g., in German Publication DE-0S 3722164. Because in the turbomolecular pump disclosed in DE-0S 3722164 for transmitting the heat, only minimal contact surfaces are available, the transmission of heat from the stator discs to the housing and, thereby, outwardly is not adequate.

The other factors, which require an adequate heat removal are as follows:

Turbomolecular pumps are primarily used in processes, such as, e.g., chemical process or a manufacturing process for producing semiconductors, which require use of large amounts of process gases. As a rule, these process gases easily condensate, in particular, at low temperatures. This results in a noticeable precipitation of liquid or solids, which cause corrosion and caustic process that can lead to destruction of individual components of a turbomolecular pump or to a destruction of the entire pump.

By heating of corresponding regions liquid and solid precipitation can be eliminated to a large extent, as discussed in German publication DE-0S 197 02 456. The heating is effected with corresponding elements provided on or in the pump housing. However, because, as described above, only minimal contact surfaces between the housing, spacer rings, and stator discs are provided in conventional turbomolecular pumps, the heat transfer between the housing and the stator discs is unsatisfactory.

These two factors, namely, transfer of heat from stator discs to the housing and in the opposite direction, are critical for a reliable operation of a turbomolecular pump.

Accordingly, an object of the present invention is to provide a turbomolecular pump with a noticeably improved heat transfer from the housing to the stator discs and in the opposite direction.

SUMMARY OF THE INVENTION

This and other objects of the present invention, which will become apparent hereinafter, are achieved by providing a turbomolecular pump in which a support ring of a stator disc located adjacent to a high pressure region of the turbomolecular pump, is connected with an adjacent housing part over a large surface.

The large-surface contact between the support ring of the stator disc, which is located adjacent to the high-pressure region of the pump, and the adjacent housing parts provides for noticeably better heat transfer between the stator disc and the housing than in conventional turbomolecular pumps.

The objects of the invention are also achieved when the support ring of the stator disc, which is located adjacent to the high pressure region of the pump, is formed integrally, as one-piece, with the adjacent housing part.

A large contact surface between the support ring of the last stator disc with the adjacent housing part or the formation of the support ring of the last stator disc integrally with the adjacent housing part, together with large opposite surfaces of the stator and rotor discs, noticeably increases heat transfer from the rotor discs to the housing and in the opposite direction. The present invention permits to deliver larger quantities of gases at the same rotor temperature.

The formation of a cooling water channel in the connection region of the support ring of the last stator disc with the adjacent housing part or, alternatively, in the housing part further increases heat transfer between the stator disc and the housing.

For heating the stator, heating means can be provided in the support ring or the adjacent housing part in a, space-saving manner. Advantageously, the adjacent housing part is thermally insulated from the rest of the housing. In this way, heating of a critical region of the pump without significant heat losses becomes possible.

The support ring of the last stator disc can be formed either as an inner ring or as an outer ring. This permits to adapt the arrangement according to the present invention to different constructions of turbomolecular pump.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
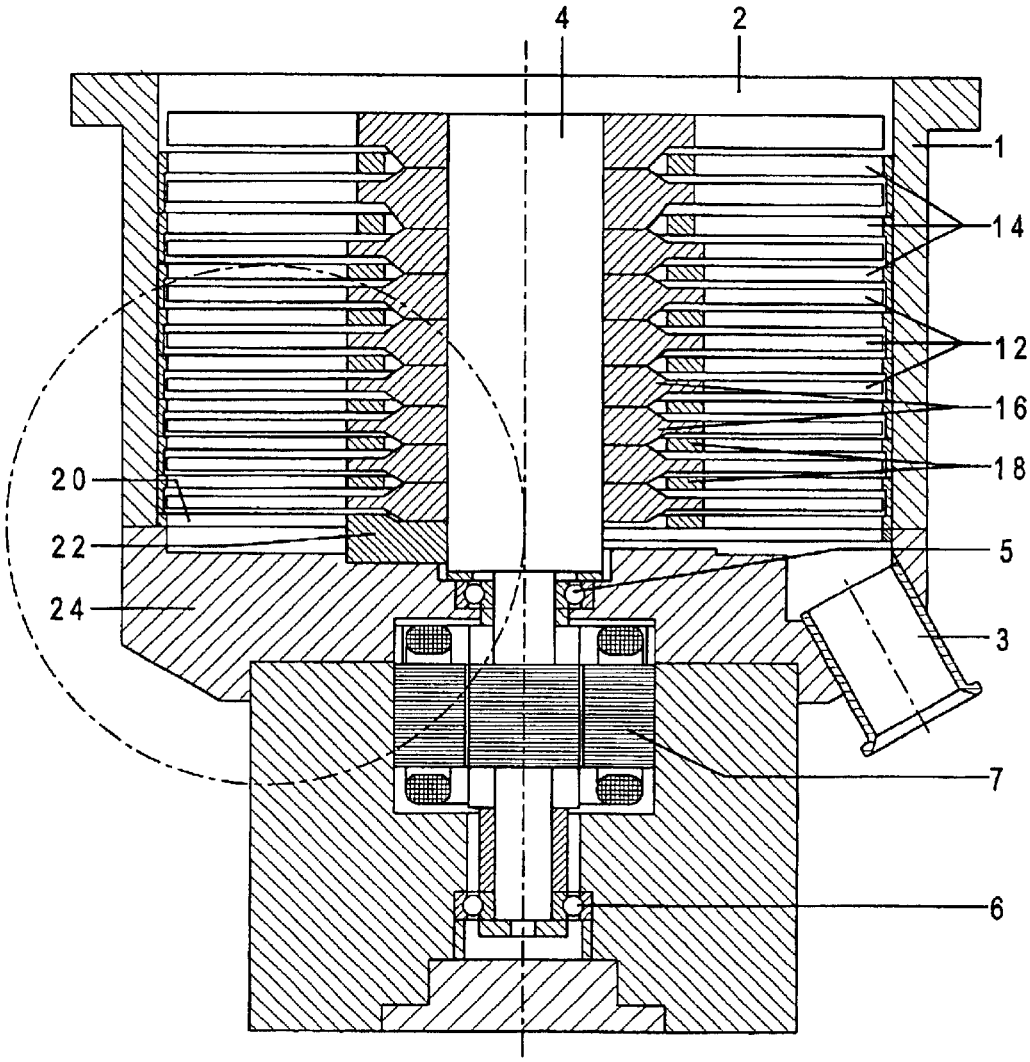
FIG. 1 shows a cross-sectional view of a turbomolecular pump according to the present invention.

A turbomolecular pump according to the present invention, which is shown in FIG. 1, has a housing 1 having a suction opening 2 and a gas outlet opening 3. A rotor shaft 4 of the turbomolecular pump is supported in bearings 5 and 6 and is driven by a motor 7. A plurality of rotor discs 12 are secured on the rotor shaft 7. The rotor discs 12 are provided with a pump active structure and cooperate with stator discs 14 likewise provided with a pump active structure, for producing a pumping actin.

The rotor and stator discs 12, 14 are provided, respectively, with support rings 16, 18 for supporting the blades. The stator and rotor discs 12, 14 are arranged alternatingly one behind the other.

Figure 2:
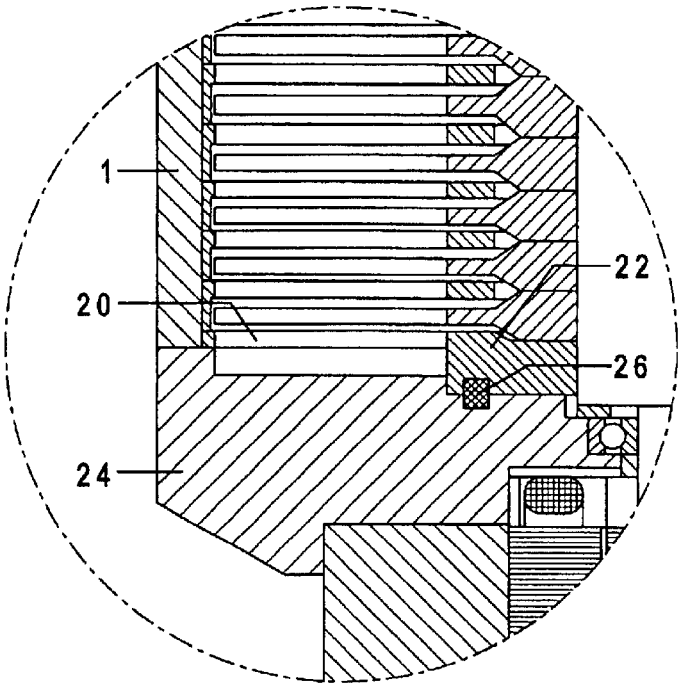
FIG. 2 shows a cross-sectional view of a portion of the turbomolecular pump according to a first embodiment of the inventive turbomolecular pump.

FIG. 2, as discussed above, shows a portion of the inventive turbomolecular pump according to the first embodiment. In the embodiment of the turbomolecular pump shown in FIG. 2, the stator disc 20, which is located adjacent to the high pressure region, is provided with a support ring 22. The support ring 22 of the adjacent to the high pressure region, stator disc 20 is connected with the adjacent housing part 24 along a large surface. In a modified embodiment of the turbomolecular pump shown in FIG. 2 cooling water channel 26 is formed in the connection region of the support ring 22 with the housing part 24. Advantageously, the channel 26 is so formed that it has a contact area with both the support ring 22 and the housing part 24. Alternatively, the cooling water channel can be formed directly in the support ring 22 of the stator disc 20 or in the housing part 24.

Figure 3:
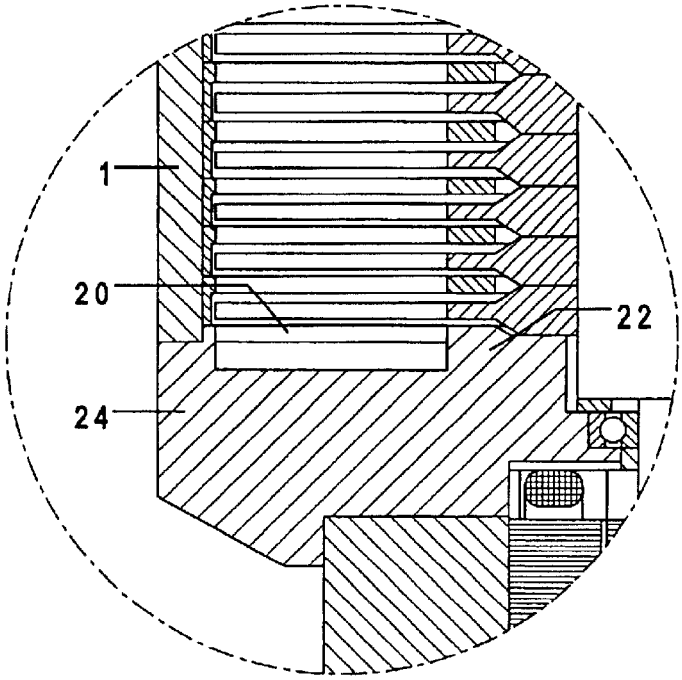
FIG. 3 shows a cross-sectional view of a portion of the turbomolecular pump according to a further embodiment of the inventive turbomolecular pump.

In the embodiment of the inventive turbomolecular pump shown in FIG. 3, the stator disc 20 and the housing part 24 form a one-piece part.

Figure 4:
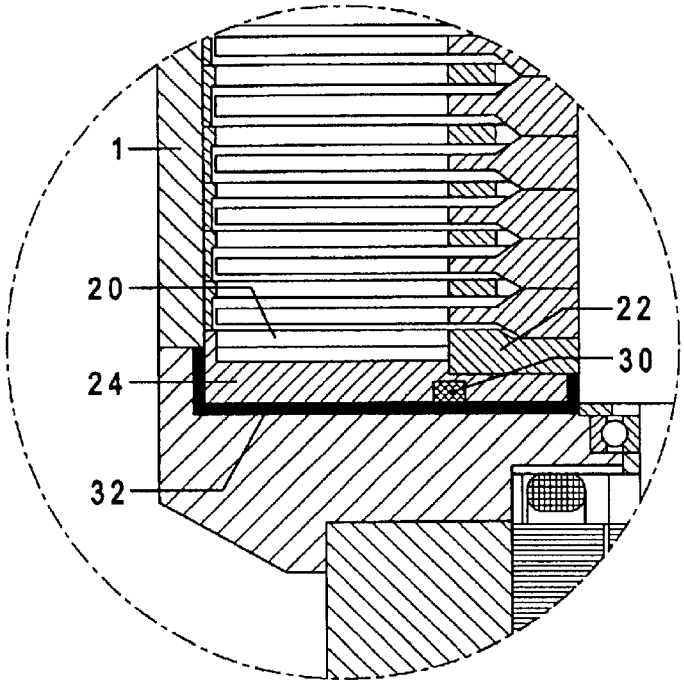
FIG. 4 shows a cross-sectional view of a portion of the turbomolecular pump according to another embodiment of the inventive turbomolecular pump.

In the embodiment of the invention turbomolecular pump shown in FIG. 4, heating means 30 is provided. To insure an appropriate thermal effect, the housing part 24 is separated from the rest of the housing 1 by heat insulation 32. While in the embodiment shown in FIG. 4, the support ring 22 and the housing part 24 are formed as separate parts, they can also be formed as a one-piece part, as in the embodiment shown in FIG. 3.

Figure 5:
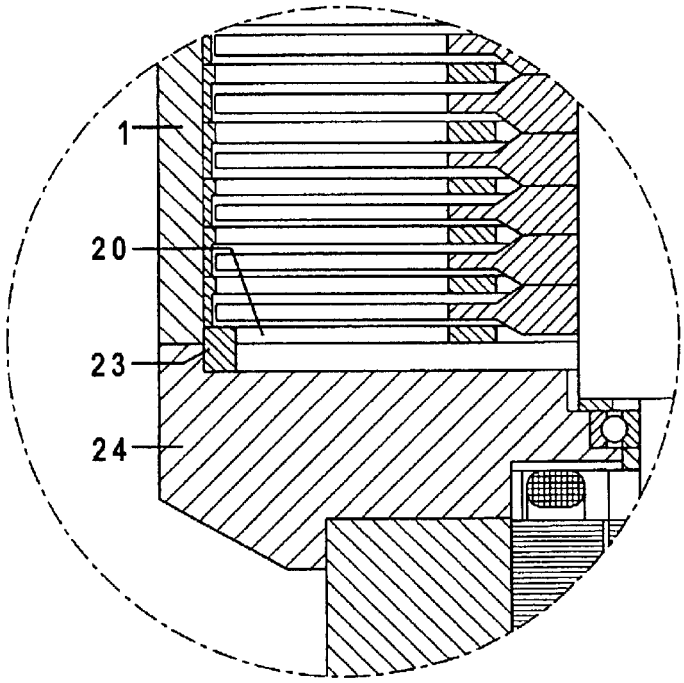
FIG. 5 shows a cross-sectional view of a portion of the turbomolecular pump according to yet another embodiment of the inventive turbomolecular pump.

In the embodiment of the inventive turbomolecular pump shown in FIG. 5, the support ring 23 is formed as an outer ring. In this embodiment, the features particular to the embodiments shown in FIGS. 2–4, can also be incorporated. Thus, the support ring 23 can be formed together with the housing part 24 as a one-piece part, and a cooling water channel or heating means can be provided in the connection area of the support ring 23 with the housing part 24.

Though the present invention was shown and described with references to the preferred embodiments, such are merely illustrative of the present invention and are not to be construed as a limitation thereof and various modification of the present invention will be apparent to those skilled in the art. It is the therefore not intended that the present invention be limited to the disclosed embodiments or details thereof, and the present invention includes all variations and/or alternative embodiments within the spirit and scope of the present invention as defined by the appended claims.

What is claimed is:

1. A turbomolecular pump, comprising a housing having a suction opening and a gas outlet opening; a plurality of alternatingly arranged one behind another, stator and rotor discs; and a plurality of support rings for supporting respective ones of the stator and rotor discs, wherein a support ring of a stator disc located adjacent to a high pressure region of the turbomolecular pump, is connected with an adjacent housing part over a large surface, and wherein heating means is provided in the housing part.

2. A turbomolecular pump as set forth in claim 1, wherein the housing part is separated from rest of the housing by thermal insulation.

3. A turbomolecular pump, comprising a housing having a suction opening and a gas outlet opening; a plurality of alternatingly arranged one behind another, stator and rotor discs; and a plurality of support rings for supporting respective ones of the stator and rotor discs, wherein a support ring of a stator disc located adjacent to a high pressure region of the turbomolecular pump, and an adjacent housing pat are formed as a one-piece part, wherein a cooling water channel is formed in the housing part.

4. A turbomolecular pump as set forth in claim 3 wherein the support ring of the stator disc located adjacent to the high pressure regions of the turbomolecular pump is formed as one of an inner ring and an outer ring.

5. A turbomolecular pump, comprising a housing having a suction opening and a gas outlet opening; a plurality of alternatingly arranged one behind another, stator and rotor discs; and a plurality of support rings for supporting respective ones of the stator and rotor discs, wherein a support ring of a stator disc located adjacent to a high pressure region of the turbomolecular pump, and an adjacent housing part are formed as a one-piece part, and wherein heating means is provided in the housing part.

6. A turbomolecular pump as set forth in claim 5, wherein the housing part is separated from the rest of the housing by thermal insulation.

7. A turbomolecular pump, comprising a housing having a suction opening and a gas outlet opening; a plurality of alternatingly arranged one behind another, stator and rotor discs; and a plurality of support rings for supporting respective ones of the stator and rotor discs, with a support ring of a stator disc located immediately adjacent to a high pressure region of the turbomolecular pump, being connected with an adjacent housing part over a large surface; and means for cooling the pump and provided exclusively in the connection region of the support ring of the stator disc located immediately adjacent to the high pressure region of the pump, with the adjacent housing part.

8. A turbomolecular pump according to claim 7, wherein the cooling means comprises a cooling water channel formed in the adjacent housing part.

9. A turbomolecular pump according to claim 7, wherein the cooling means comprises a cooling water channel formed in the support ring of the stator disc located immediately adjacent to the high pressure region of the turbomolecular pump.

10. A turbomolecular pump according to claim 7, wherein the support ring of a stator disc located immediately adjacent to a high pressure region of the turbomolecular pump, and the adjacent housing part are formed as a one-piece part.

11. A turbomolecular pump as set forth in claim 7, wherein the support ring of the stator disc located immediately adjacent to the high pressure regions of the turbomolecular pump is formed as one of an inner ring and an outer ring.

* * * * *